US010294555B2

(12) United States Patent
Kaneko

(10) Patent No.: US 10,294,555 B2
(45) Date of Patent: May 21, 2019

(54) COPPER ALLOY SHEET MATERIAL, CONNECTOR, AND METHOD OF PRODUCING A COPPER ALLOY SHEET MATERIAL

(71) Applicant: FURUKAWA ELECTRIC CO., LTD., Tokyo (JP)

(72) Inventor: Hiroshi Kaneko, Tokyo (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 421 days.

(21) Appl. No.: 15/192,256

(22) Filed: Jun. 24, 2016

(65) Prior Publication Data

US 2016/0305002 A1 Oct. 20, 2016

Related U.S. Application Data

(63) Continuation of application No. PCT/JP2014/084432, filed on Dec. 25, 2014.

(30) Foreign Application Priority Data

Dec. 27, 2013 (JP) ..... 2013-273521

(51) Int. Cl.

| | |
|---|---|
| ***C22F 1/08*** | (2006.01) |
| ***C22C 9/06*** | (2006.01) |
| ***H01B 1/02*** | (2006.01) |
| ***B22D 21/00*** | (2006.01) |
| ***C22C 1/02*** | (2006.01) |

(52) U.S. Cl.
CPC ..... *C22F 1/08* (2013.01); *B22D 21/005* (2013.01); *C22C 1/02* (2013.01); *C22C 9/06* (2013.01); *H01B 1/026* (2013.01)

(58) Field of Classification Search
CPC ..... C22F 1/08
See application file for complete search history.

(56) References Cited

U.S. PATENT DOCUMENTS

| | | | |
|---|---|---|---|
| 5,028,282 | A | 7/1991 | Kubozono et al. |
| 2012/0148439 | A1 | 6/2012 | Shishido et al. |
| 2012/0241056 | A1 | 9/2012 | Sato et al. |

FOREIGN PATENT DOCUMENTS

| | | | |
|---|---|---|---|
| EP | 2610359 | A1 | 7/2013 |
| EP | 2706125 | A1 | 3/2014 |
| JP | 63-312937 | A | 12/1988 |
| JP | 2002-294367 | A | 10/2002 |
| JP | 2006-9108 | A | 1/2006 |
| JP | 2006-152392 | A | 6/2006 |
| JP | 2011-132594 | A | 7/2011 |
| JP | 2012-122114 | A | 6/2012 |
| JP | 2012-177153 | A | 9/2012 |
| JP | 2013-163853 | A | 8/2013 |
| WO | WO 2011/068134 | A1 | 6/2011 |
| WO | WO 2012/026611 | A1 | 3/2012 |
| WO | WO 2012/150702 | A1 | 11/2012 |

OTHER PUBLICATIONS

International Search Report for PCT/JP2014/084432 (PCT/ISA/210) dated Apr. 7, 2015.
Written Opinion of the International Searching Authority for PCT/JP2014/084432 (PCT/ISA/237) dated Apr. 7, 2015.

*Primary Examiner* — Jessee R Roe
*Assistant Examiner* — Jophy S. Koshy
(74) *Attorney, Agent, or Firm* — Birch, Stewart, Koalsch & Birch, LLP

(57) ABSTRACT

A copper alloy sheet material, having an alloy composition containing at least one of Ni and Co in an amount of 1.80 to 8.00 mass % in total, Si in an amount of 0.40 to 2.00 mass %, and at least one element selected from the group consisting of Sn, Zn, Ag, Mn, P, Mg, Cr, Zr, Fe, and Ti in an amount of 0.000 to 2.000 mass % in total, with the balance being copper and unavoidable impurities, wherein the orientation density of the {121}<111> orientation is 6 or less, and the orientation density of the {110}<001> orientation is 4 or more; and wherein the density of grains having the {110}<001> orientation is 0.40 grains/$\mu m^2$ or more; a connector using thereof; and a method of producing the copper alloy sheet material.

4 Claims, 2 Drawing Sheets

{Fig. 4}
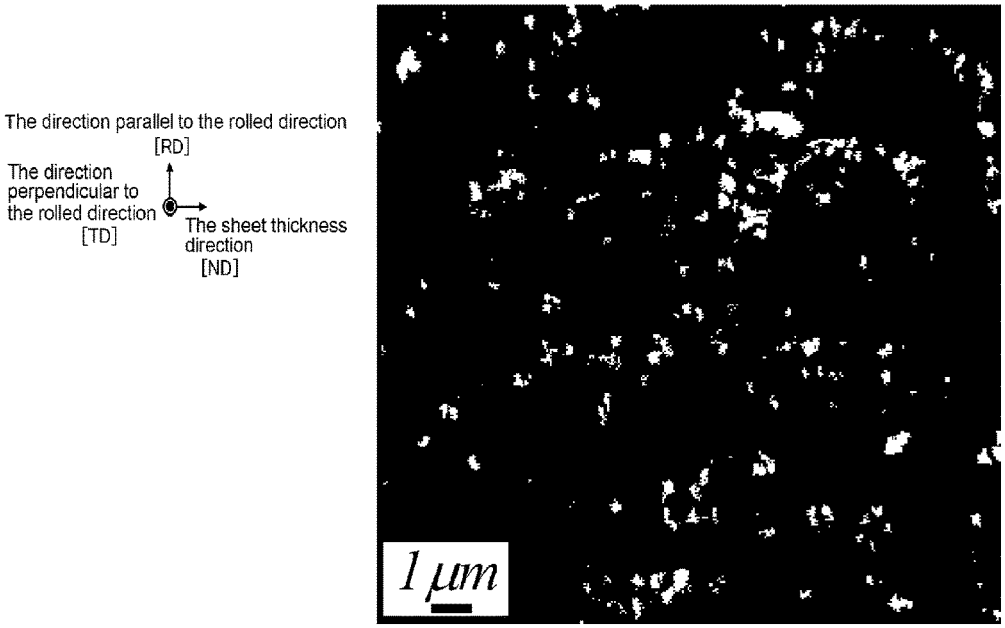
{Fig. 5}
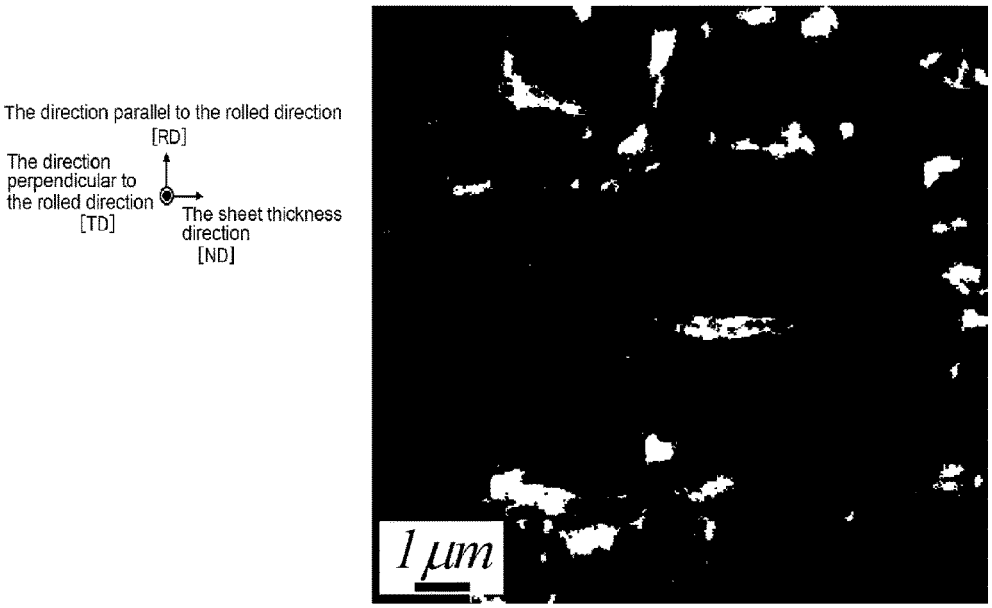

COPPER ALLOY SHEET MATERIAL, CONNECTOR, AND METHOD OF PRODUCING A COPPER ALLOY SHEET MATERIAL

CROSS-REFERENCE TO RELATED APPLICATIONS

This application is a Continuation of PCT International Application No. PCT/JP2014/084432 filed on Dec. 25, 2014, which claims priority under 35 U.S.C. § 119 (a) to Japanese Patent Application No. 2013-273521 filed in Japan on Dec. 27, 2013. Each of the above applications is hereby expressly incorporated by reference, in its entirety, into the present application.

TECHNICAL FIELD

The present invention relates to a copper alloy sheet material and a connector using thereof, and a method of producing the copper alloy sheet material.

BACKGROUND ART

Along with making size of electric or electronic equipment smaller in recent years, making size of terminals and contact components smaller is underway. For example, in regard to an electrical contact, when the size of a member that constitutes a spring becomes small, the length of the spring is shortened, and thereby, the load stress applied to the copper alloy for spring is increased. When that stress becomes higher than the yield point of the copper alloy material, the material is permanently deformed, and the desired contact pressure as a spring may not be obtained. In that case, the contact resistance is increased, and the electrical connection becomes insufficient, which becomes a serious problem. Therefore, a copper alloy is required to have high strength.

Further, bending workability is generally in a relationship of trade-off with strength. Further, along with making size of electric or electronic equipment smaller, it is necessary to lower the bending radius in bending that is applied to a material. In view of the technical trend of electronic equipment as such, a material having high strength and excellent bending workability is needed.

Further, when each of individual terminals becomes small-sized, there is a problem that the cross-sectional area through which electricity flows is decreased, and a desired current cannot be passed through. For example, a copper alloy that is commonly used as a terminal material is phosphor bronze. However, when the copper alloy has an alloying composition for high strength, the electrical conductivity is around 10% IACS, and this is insufficient for small-sized terminals. Further, when an electronic instrument becomes small-sized, the thermal capacity is reduced, and when the amount of Joule heating of a conductor is high, this is directly related to the overall temperature elevation of the instrument, which is a problem. Therefore, a copper alloy is required to have satisfactory electrical conductivity.

However, the high strength (for example, high yield strength) and the satisfactory electrical conductivity described above are contradictory characteristics in a copper alloy. In this regard, attempts have been, hitherto, made to achieve high strength and satisfactory electrical conductivity in various copper alloys.

Patent Literature 1 proposes that a copper alloy having high strength and satisfactory fatigue characteristics is obtained, by selecting an alloying composition containing the alloying components of a Cu—Ni—Sn-based alloy, and subjecting the alloy to age-precipitation hardening via a particular process.

Patent Literature 2 proposes that a copper alloy having high strength is obtained, by regulating the grain diameter of a Cu—Sn-based alloy and the finish-rolling conditions.

Patent Literature 3 proposes that in the case where the Ni concentration in a Cu—Ni—Si-based alloy is high, the alloy is made to having high strength by preparing the alloy via a particular process.

Patent Literature 4 proposes that a copper alloy having high strength is obtained, by selecting an alloying composition containing the alloying components of a Cu—Ti-based alloy, and subjecting the alloy to age-precipitation hardening via a particular process.

Patent Literature 5 proposes that by obtaining a Cu—(Ni, Co)—Si-based alloy sheet material via a particular production process, the area ratio of the (100) plane facing the RD is increased, the area ratio of the (111) plane facing the RD is decreased, and thereby an alloy is obtained, which has a low Young's modulus of 110 GPa or less in the rolled direction (RD).

Patent Literature 6 proposes that by obtaining a Cu—Ni—Si-based alloy strip via a particular production process, a predetermined {110}<001> orientation density and a predetermined Kernel average misorientation (KAM) value are obtained, and the deep-drawing workability and the fatigue resistance characteristics are enhanced.

Patent Literature 7 proposes that by obtaining a Cu—Ni—Si-based alloy strip via a particular production process, integration to the (220) plane is increased, thus I(220) has a high predetermined X-ray diffraction intensity and a particle size having a predetermined relationship between the transverse (sheet width) direction and the sheet thickness direction, and bending workability is enhanced, which is in the Good Way bending in which the bending axis is perpendicular to the rolled direction.

Patent Literature 8 proposes that when a Cu—Ni—Si-based alloy sheet is obtained via a particular production process, the alloy has the texture having a proportion of the {001}<100> orientation of 50% or more, which alloy does not have any lamellar grain boundaries and has high strength and improved bending workability.

CITATION LIST

Patent Literatures

Patent Literature 1: JP-A-63-312937 ("JP-A" means unexamined published Japanese patent application)
Patent Literature 2: JP-A-2002-294367
Patent Literature 3: JP-A-2006-152392
Patent Literature 4: JP-A-2011-132594
Patent Literature 5: WO 2011/068134 A1
Patent Literature 6: JP-A-2012-122114
Patent Literature 7: JP-A-2006-9108
Patent Literature 8: JP-A-2006-152392

SUMMARY OF INVENTION

Technical Problem

In Patent Literatures 1 to 4, high strength was obtained as compared to general copper alloys. However, there were occasions in which the electrical conductivity was still low, depending on the alloy system (the alloying composition)

and the production method. Further, the bending workability was still insufficient. Further, in Patent Literatures 5 to 8, high electrical conductivity and satisfactory bending workability are obtained, but there is room for further enhancement in view of yield strength.

Thus, there is a demand for a copper alloy sheet material which has satisfactory electrical conductivity, has high yield strength, and has satisfactory bending workability.

In view of the tasks as described above, the present invention is contemplated for providing: a copper alloy sheet material in which a balance is achieved among high yield strength, satisfactory bending workability, and satisfactory electrical conductivity; a connector using the copper alloy sheet material, and a method of producing the copper alloy sheet material. Particularly, the present invention is contemplated for providing: a copper alloy sheet material that is suitable for relays, switches, sockets and the like for electrical or electronic equipment; connectors, terminal materials and the like for automotive vehicles and the like; a copper alloy sheet material suitable for an electroconductive spring material to be used for electronic equipment components, such as an auto-focus camera module, and the like, a connector for flexible printed circuit (FPC), and the like; a connector using the copper alloy sheet material; and a method of producing the copper alloy sheet material.

Solution to Problem

The inventor of the present invention has conducted thorough investigations in order to solve the problems described above. As a result, the inventor of the present invention has found that when integration into the {121}<111> orientation is suppressed, while integration into the {110}<001> orientation is enhanced, and when the grains of the {110}<001> orientation are dispersed in a highly compact state, a balance can be achieved among high strength and satisfactory bending workability, while satisfactory electrical conductivity is obtained. More particularly, the inventor of the present invention has found that strength can be enhanced while satisfactory electrical conductivity is obtained, and while bending workability equivalent to the conventional cases is maintained. The present invention was completed based on those findings.

That is, the present invention is to provide the following means:

(1) A copper alloy sheet material, having an alloy composition containing at least one of Ni and Co in an amount of 1.80 to 8.00 mass % in total, and Si in an amount of 0.40 to 2.00 mass %, with the balance being copper and unavoidable impurities, wherein the orientation density of the {121}<111> orientation is 6 or less, and the orientation density of the {110}<001> orientation is 4 or more; and wherein the density of grains having the {110}<001> orientation is 0.40 grains/$\mu m^2$ or more.

(2) A copper alloy sheet material, having an alloy composition containing at least one of Ni and Co in an amount of 1.80 to 8.00 mass % in total; Si in an amount of 0.40 to 2.00 mass %; and at least one element selected from the group consisting of Sn, Zn, Ag, Mn, P, Mg, Cr, Zr, Fe, and Ti in an amount of 0.000 to 2.000 mass % in total, with the balance being copper and unavoidable impurities, wherein the orientation density of the {121}<111> orientation is 6 or less, the orientation density of the {110}<001> orientation is 4 or more, and wherein the density of grains having the {110}<001> orientation is 0.40 grains/$\mu m^2$ or more.

(3) The copper alloy sheet material described in item (2), which contains at least one element selected from the group consisting of Sn, Zn, Ag, Mn, P, Mg, Cr, Zr, Fe, and Ti in an amount of 0.005 to 2.000 mass % in total.

(4) The copper alloy sheet material described in any one of items (1) to (3), wherein a Vickers hardness is 280 or more.

(5) A connector formed to contain the copper alloy sheet material described in any one of items (1) to (4).

(6) A method of producing a copper alloy sheet material, comprising the steps of: melting and casting of raw materials having an alloying composition containing at least one of Ni and Co in an amount of 1.80 to 8.00 mass % in total, and Si in an amount of 0.40 to 2.00 mass %, with the balance being copper and unavoidable impurities; intermediate cold-rolling with a working ratio of 20% to 70%; aging treatment of performing a heat treatment for 5 minutes to 10 hours at 300° C. to 440° C.; and final cold-rolling with a working ratio of 90% or more, in this order.

(7) A method of producing a copper alloy sheet material, comprising the steps of: melting and casting of raw materials having an alloying composition containing at least one of Ni and Co in an amount of 1.80 to 8.00 mass % in total, Si in an amount of 0.40 to 2.00 mass %, and at least one element selected from the group consisting of Sn, Zn, Ag, Mn, P, Mg, Cr, Zr, Fe, and Ti in an amount of 0.000 to 2.000 mass % in total, with the balance being copper and unavoidable impurities; intermediate cold-rolling with a working ratio of 20% to 70%; aging treatment of performing a heat treatment for 5 minutes to 10 hours at 300° C. to 440° C.; and final cold-rolling with a working ratio of 90% or more, in this order.

(8) The method of producing a copper alloy sheet material described in item (7), wherein the copper alloy sheet material contains at least one element selected from the group consisting of Sn, Zn, Ag, Mn, P, Mg, Cr, Zr, Fe, and Ti in an amount of 0.005 to 2.000 mass % in total.

(9) The method of producing a copper alloy sheet material described in any one of items (6) to (8), which carries out, in this order, the steps of: homogenization heat treatment of performing a heat treatment for one hour or more at 960° C. to 1,040° C.; and hot-working with a working ratio of 10% to 90% at a temperature range of 500° C. to 1,040° C. from the initiation to the end of the hot-working, between the melting and casting step and the intermediate cold-rolling step, and which carries out: no heat treatment at 480° C. or higher, after the hot-working step.

(10) The method of producing a copper alloy sheet material described in any one of items (6) to (9), which carries out a step of: stress-relief annealing of maintaining the copper alloy sheet material for 5 seconds to 2 hours at 200° C. to 430° C., after the final cold-rolling step.

Advantageous Effects of Invention

The copper alloy sheet material of the present invention has characteristics in which a balance is achieved among high yield strength, satisfactory bending workability, and satisfactory electrical conductivity.

Therefore, the copper alloy sheet material of the present invention can be preferably used for: relays, switches, sockets and the like for electrical/electronic equipment; connectors, terminal materials and the like for automotive vehicles and the like; electroconductive spring materials to be used in electronic equipment components, such as auto-focus camera modules; connectors for flexible printed circuit (FPC); and the like.

Further, since the copper alloy sheet material of the present invention has high yield strength while having bending workability that is equivalent to that of conventional copper alloy sheet materials, the copper alloy sheet material of the invention can be used as a material for a spring, which is not apt to be permanent set in fatigue (resistance to settling). For this reason, the copper alloy sheet material is preferable, for example, as a connector material.

Further, according to the method of producing a copper alloy sheet material of the present invention, the copper alloy sheet material having the excellent characteristics described above can be produced preferably.

BRIEF DESCRIPTION OF DRAWINGS

FIG. 2 is a schematic diagram illustrating a unit cell of the {110}<001> orientation and the directions of the copper alloy crystals.

FIG. 3 is a schematic diagram illustrating a unit cell of the {001}<100> orientation and the directions of the copper alloy crystals.

FIG. 4 is a grain boundary map (magnification of a portion of the measurement viewing field) of Example 204 obtained via FE-SEM/EBSD measurement. In the map, only the grains of the {110}<001> orientation are indicated in white color.

FIG. 5 is a grain boundary map (magnification of a portion of the measurement viewing field) of Comparative Example 252 obtained via the FE-SEM/EBSD measurement. Similarly to FIG. 4, in the map, only the grains of the {110}<001> orientation are indicated in white color.

MODE FOR CARRYING OUT THE INVENTION

Figure 1:
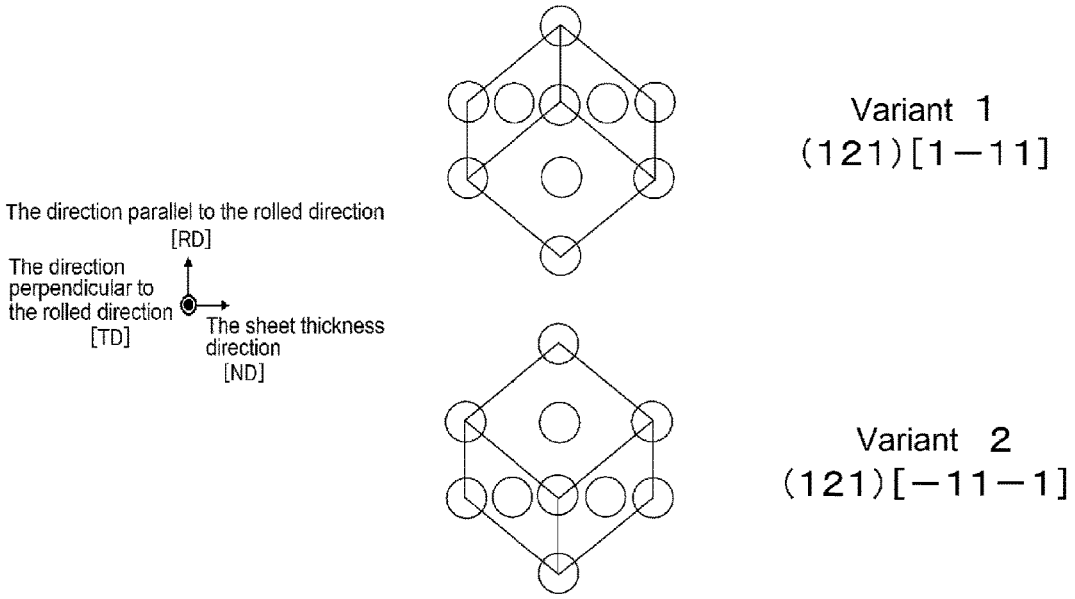
FIG. 1 is a schematic diagram illustrating two variant unit cells of the {121}<111> orientation and the directions of the copper alloy crystals.
Figure 1:
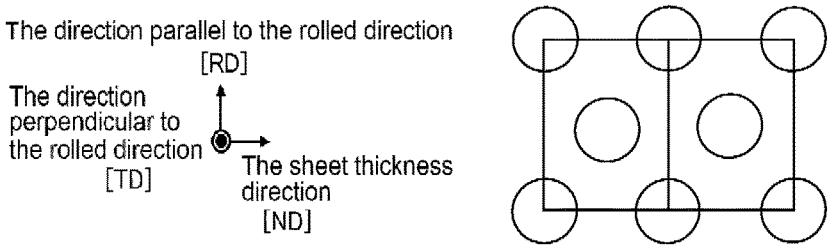
Figure 1:
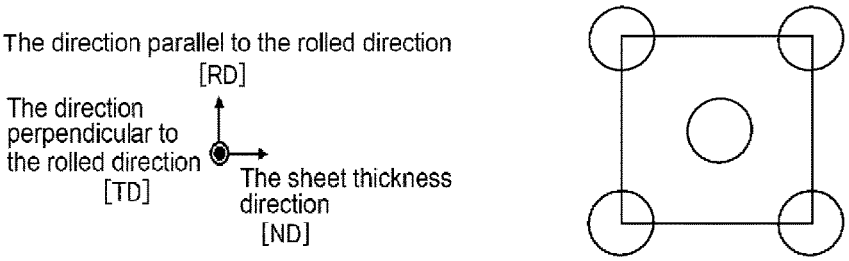

Preferable embodiments of the copper alloy sheet material of the present invention will be described in detail. Herein, the term "copper alloy material" means a product obtained after a copper alloy base material is worked into a predetermined shape (for example, sheet, strip, foil, rod, or wire). Among those, a sheet material refers to a material, which has a particular thickness, is stable in shape, and is extended in the planar direction, and in a broad sense, the sheet material is meant to include a strip material, a foil material, and a tube material obtained by working the sheet into a tube shape.

The Cu—(Ni, Co)—Si-based alloy to be used for the copper alloy sheet material of the present invention is a precipitation-hardened type alloy, and it is known that as Ni—Si-based compounds, Co—Si-based compounds, Ni—Co—Si-based compounds and the like are dispersed as particles having a size of approximately 10 nm in a copper matrix as a second phase, and that high strength is obtained. However, in this strengthening mechanism relying on precipitation-hardening, a satisfactory balance is not necessarily achieved between strength and bending workability, which are in a trade-off relationship. Therefore, the inventor of the present invention has investigated another strengthening mechanism. As a result, the inventor of the present invention has confirmed that these trade-off characteristics are satisfied by appropriately controlling both the macroscopic degree of integration of the crystal orientation and the uniformity at a microscopic level. Thus, the present invention was finally completed.

Usually, a face-centered cubic metal, such as copper, has twelve slip systems. A crystal undergoes slip deformation to cause the (111) plane to face the <011> direction, and that microscopic shear strain leads to macroscopic plastic strain. Since the outer side of bending of a material in bending deformation is subject to plastic constraint such that elongation in the direction of bending, shrinkage in the sheet thickness direction, and strain in the transverse direction is almost zero, there are fewer slip systems that are easily with activity. As a result, in the case where plastic deformation caused by crystal slippage is difficult, a local deformation zone or a shear zone is formed as a secondary deformation mechanism, and these zones become responsible for most of plastic strain. Then, deformation is concentrated on these local sites, and cracks occur along these regions. Since the {121}<111> orientation requires many slip deformations due to the geometric configuration of the slip systems, local deformations, such as shear zones, may easily occur, and as a result, cracks are apt to occur. On the other hand, the {110}<001> orientation forms efficient macroscopic plastic strain with fewer slip deformations due to the geometric configuration of the slip systems. Thus, local deformations, such as shear zones, do not hardly occur, and cracks are suppressed. Therefore, it is effective for preventing cracks in bending deformation to decrease the {121}<111> orientation and to increase the {110}<001> orientation.

(Orientation Density Given by ODF Analysis)

There are two ways to analyze the orientation density, such as (1) a method based on the X-ray pole figures, and (2) a method following the FE-SEM/EBSD method. Herein, FE-SEM/EBSD is an abbreviation for field emission electron gun-type scanning electron microscope/electron backscatter diffraction.

(1) Method Based on X-Ray Pole Figures

The incomplete pole figures of the {111}, {100}, and {110} planes are measured from the sheet material surface. The measurement is carried out by setting the sample size of the measurement surface to 25 mm×25 mm. The sample size can be made smaller by making the beam diameter of X-rays smaller. Based on three pole figures thus measured, an orientation distribution function (ODF) analysis is carried out. The orientation density represents how many times integration has been achieved when a random crystal orientation distribution state is designated as 1. This is commonly used as a method of quantitatively evaluating the crystal orientation distribution. Symmetry of the sample was made orthotropic (the object having mirror surfaces in RD and TD), and the order of expansion is $22^{nd}$ order. The orientation densities of the {121}<111> orientation and the {110}<001> orientation, and the {001}<100> orientation are determined similarly.

As illustrated in FIG. 1, FIG. 2, and FIG. 3, according to symmetry of the crystal, there are two variants of the {121}<111> orientation, there is one variant of the {110}<001> orientation, and there is one variant of the {001}<100> orientation. The orientation density in the present invention is defined by the orientation density just for one variant. Herein, the method of indicating the orientation is such that a Cartesian coordinate system is employed, representing the rolled direction (RD) of the sheet material in the X-axis, the transverse direction (TD) of the sheet material in the Y-axis, and the direction (ND) normal to the rolled direction of the sheet material in the Z-axis, various regions in the sheet material are indicated in the form of (h k l) [u v w], using the index (h k l) of the crystal plane that is perpendicular to the Z-axis (parallel to the rolled plane) and the index [u v w] of the crystal direction that is parallel to the X-axis (perpendicular to the rolled plane). The orientation is indicated by varying the kind of the parentheses, such that (h k l) [u v w] in the case where a single crystal orientation is expressed, and that {h k l}<u v w> in the case where all of the orientations that are equivalent under symmetry.

(2) Method Following the FE-SEM/EBSD Method

The ODF can also be obtained from a crystal orientation distribution measurement according to an EBSD method. Particularly, it is preferable to use an FE-SEM/EBSD method, in which the diameter of the electron beam is small, and in which the positional resolution is high. In the case of the EBSD method, the crystal orientation is determined using a Kikuchi pattern. However, in the case where the strain of the crystal lattice is large, the Kikuchi pattern becomes unclear, and the number of unanalyzable points increases. When these unanalyzable points occupy about 20% or less of all measurable points, measurement results are obtained that are equivalent to the analysis results for the texture based on X-ray pole figures. However, in the case where the measured viewing field is narrow in the measurement by the EBSD method, the orientation densities of the (121) [1-11] orientation and the (121) [−11-1] orientation, which are two variants of the {121}<111>, may differ. In that case, it is necessary to secure a large number of viewing fields so that the orientation densities of these equivalent orientation variants become equivalent.

In the present invention, when the orientation density of the {121}<111> orientation evaluated by the methods described above is suppressed to be 6 or less, and when the orientation density of the {110}<001> orientation is increased to 4 or more, satisfactory characteristics are obtained. The orientation density of the {121}<111> orientation is more preferably 4 or less, and further preferably 2 or less. Further, the orientation density of the {110}<001> orientation is more preferably 7 or more, and further preferably 9 or more. In the present invention, it is more preferable that the orientation density of the {121}<111> orientation is 4 or less and the orientation density of the {110}<001> orientation is 7 or more, and it is further preferably that the orientation density of the {121}<111> orientation is 2 or less and the orientation density of the {110}<001> orientation is 9 or more. The upper limit of the orientation density of the {110}<001> orientation is not particularly limited, but the orientation density is usually 100 or less.

Further, the orientation density of the {001}<100> orientation is preferably 3 or less. The orientation density of the {001}<100> orientation is more preferably 2 or less, and further preferably 1 or less. The orientation density of the {001}<100> orientation is particularly preferably 0, that is, it is particularly preferable that grains of the {001}<100> orientation do not exist at all. This is because if the orientation density of the {001}<100> orientation is too high, yield strength may be lowered in some cases.

As long as any special rolling, such as unlubricated rolling, warm rolling, or asymmetric rolling, is not carried out, similar structures (textures) are formed in the sheet thickness direction, and therefore, the position in the sheet thickness direction at which the crystal orientation distribution is evaluated, is not intended to be limited to the surface.

In the present invention, "X'PERT PRO" manufactured by PANalytical B.V. is used for the measurement of the X-ray pole figures, and an analytical software "STANDARD ODF" of Norm Engineering Pty. Ltd. is used for an ODF analysis.

Further, regarding the EBSD measurement, "JSM-7001F" of JEOL, Ltd. is used for FE-SEM with an electron beam source, and "OIM5.0 HIKARI" of TSL Solutions, Ltd. is used as a camera for analyzing a Kikuchi pattern for EBSD analysis.

Further, a software program of TSL Solutions, Ltd., "OIM ANALYSIS 5", is used for an analysis of EBSD data.

In the present invention, the crystal orientation distribution function (ODF) can be determined by a series expansion method, through calculation in which odd numbered terms are also introduced. The calculation method of odd numbered terms is as described in, for example, Light Metals, written by Hiroshi Inoue, "Three-dimensional orientation analysis for texture", pp. 358-367 (1992); Journal of Japan Institute of Metals and Materials, written by Hiroshi Inoue et al., "Determination of crystal orientation distribution function from incomplete pole figures according to repeated series expansion method", pp. 892-898, Vol. 58 (1994); and by U. F. Kocks et al., "Texture and Anisotropy", pp. 102-125, Cambridge University Press (1998).

(Density of Grains of {110}<001> Orientation)

Since grains of the {110}<001> orientation have an action of weakening the development of shear zones as described above, it is preferable that the grains are compactly dispersed in order to prevent cracks in bending deformation. Further, the grains of the {110}<001> orientation form high-angle grain boundaries with peripheral grains of other orientations. Since these grain boundaries serve as resistance to dislocation movement, the grain boundaries have an effect on obtaining high strength. However, if the grains of the {110}<001> orientation are too fine, the effect of crack prevention is not likely to be exhibited. Therefore, it is preferable that these grains have a certain size (major axis, 0.2 μm or more). The method for determining the density of the grains of the {110}<001> orientation includes: first, scanning a sample with an electron beam at an interval of 0.05 μm according to the FE-SEM/EBSD method to measure a crystal orientation map; and extracting grain data which provide a shift angle of ±20° or less in the {110}<001> orientation, which is an ideal orientation. Then, among them, the number of grains having a major axis of 0.2 μm or more is determined. The number is then divided by the entire area of measurement, and the resultant is designated as the density of grains having the {110}<001> orientation per 1 $\mu m^2$. In this specification, those grains having the {110}<001> orientation are also referred to as grains of the {110}<001> orientation or {110}<001> oriented grains.

In the present invention, as such, the {110}<001> oriented grains would strengthen by forming high-angle grain boundaries with peripheral grains, and due to the effect on resistance to cracking described above, a balance is achieved between two characteristics such as the bending workability equivalent to the conventional materials and the high yield strength. As conditions needed for this balance, it is considered that the overall amount of the {110}<001> oriented grains is large, and that the grains do not exist scarcely but the grains having a certain size or larger are uniformly dispersed.

It is necessary for the copper alloy sheet material of the present invention that grains having the {110}<001> orientation are dispersed at a high density of 0.40 grains/$\mu m^2$ or more. The density of the grains having the {110}<001> orientation is more preferably 0.55 grains/$\mu m^2$ or more, and even more preferably 0.70 grains/$\mu m^2$ or more. The upper limit of the density of grains having the {110}<001> orientation is not particularly limited, but the density is usually 20 grains/$\mu m^2$ or less. An analysis of the grains described above can also be carried out based on the observation results obtained by transmission electron microscopy.

(Alloying Composition)

Ni, Co and Si

These are elements that constitute the second phase described above. These form the intermetallic compounds. These are essentially adding elements in the present invention. The sum total of the contents of at least one of Ni and Co is 1.8 to 8.0 mass %, preferably 2.6 to 6.5 mass %, and more preferably 3.4 to 5.0 mass %. Further, the content of Si is 0.4 to 2.0 mass %, preferably 0.5 to 1.6 mass %, and more preferably 0.7 to 1.2 mass %. In the case where the amount of addition of any of these essentially adding elements is too small, the obtainable effects may become insufficient; and in the case where the amount of addition is too large, material cracking may occur in rolling steps. When Co is added, electrical conductivity is slightly improved. However, in the case where the concentrations of any of these essentially adding elements are high in a state of containing Co, rolling cracks may be apt to occur, depending on the conditions of hot-rolling and cold-rolling. Therefore, a more preferred embodiment in the present invention does not contain Co at all.

Other Elements

The copper alloy sheet material of the present invention may contain, in addition to the essentially adding elements, at last one element selected from the group consisting of Sn, Zn, Ag, Mn, P, Mg, Cr, Zr, Fe, and Ti, as an optionally adding element(s). These elements were confirmed to have their action of: controlling the orientation density of the {121}<111> orientation to be low; enhancing the orientation density of the {110}<001> orientation; enhancing the density of grains having {110}<001> orientation; and enhancing the Vickers hardness (Hv). In the case of containing any of these elements, the content of at least one element selected from the group consisting of Sn, Zn, Ag, Mn, P, Mg, Cr, Zr, Fe, and Ti is preferably set to 0.005 to 2.0 mass % in total. However, if the content of any of these optionally adding elements is too large, there may be an adverse affect of lowering the electrical conductivity, or material cracking may occur in rolling steps.

Unavoidable Impurities

Unavoidable impurities in the copper alloy are conventional elements that are contained in a copper alloy. Examples of the unavoidable impurities include O, H, S, Pb, As, Cd, and Sb. Any of these are tolerated to be contained up to a total amount of about 0.1 mass %.

(Production Method)

As a conventional method, in a usual method of producing a precipitation-hardened type copper alloy material, a supersaturated solid solution state is attained by a solution heat treatment, then the copper alloy material is subjected to precipitation by an aging treatment, and if necessary, the copper alloy material is subjected to temper rolling (finish rolling) and temper annealing (low-temperature annealing, stress-relief annealing). Production methods J, K, L, and M of Comparative Examples described below correspond to this conventional method. However, the {121}<111> orientation for which the development is wished to suppress in the present invention, is the rolling stable orientation that is enhanced by rolling in conventional copper alloys.

In this regard, in the present invention, a process different from the conventional method described above becomes effective in order to control the crystal orientation distribution and the density of the {110}<001> oriented grains. For example, a process such as described below is effective. However, as long as the crystal state as defined in the present invention is satisfied, the production method is not intended to be limited to the method described below.

An example of the method of producing the copper alloy sheet material of the present invention may include: melting and casting [Step 1] to obtain an ingot; subjecting this ingot to homogenization heat treatment [Step 2]; hot-working [Step 3], such as hot-rolling; water-cooling [Step 4]; intermediate cold-rolling [Step 5]; heat treatment for aging-precipitation [Step 6]; final cold-rolling [Step 7]; and stress-relief annealing [Step 8], in this order. The stress-relief annealing [Step 8] may be omitted if predetermined crystal control and physical properties are obtained. In the present invention, no solution heat treatment is carried out. That is to say, no heat treatment at 480° C. or higher is carried out, in the steps after the hot-rolling.

Alternatively, another example of the method of producing the copper alloy sheet material of the present invention may include: melting and casting [Step 1] to obtain an ingot; subjecting this ingot to intermediate cold-rolling [Step 5]; heat treatment for aging-precipitation [Step 6]; final cold-rolling [Step 7]; and stress-relief annealing [Step 8], in this order. In this case, it is preferable that a copper alloy has been subjected to homogenization of the alloying elements or adjustment of the sheet thickness, at the time point of the melting and casting [Step 1]. In this process as well, the stress-relief annealing [Step 8] may be omitted as long as predetermined crystal control and physical properties are obtained. Also in this case, in the present invention, no solution heat treatment is carried out. That is to say, no heat treatment at 480° C. or higher is carried out, in the steps after the hot-rolling.

The control of the crystal orientation and the density of the {110}<001> oriented grains as defined in the present invention is achieved by a combination of a series of the above-described steps, and a combination of particular conditions for the steps, such as that the conditions for the intermediate cold-rolling [Step 5] are set to a working ratio of 20% to 70%, that the conditions of the aging treatment [Step 6] are set to 300° C. to 440° C. for 5 minutes to 10 hours, and that the conditions of the working ratio for the final cold-rolling [Step 7] is set to 90% or more. This mechanism is estimated to be as follows. In the aging treatment [Step 6], the action of a (Ni, Co)—Si compound precipitated into a fine size of several nanometers or less causes a change in the distribution state of displacements or the crystal rotation in the final cold-rolling [Step 7]. By taking a high value for the rolling ratio of the final cold-rolling [Step 7], fragmentation of the grains is induced in the final cold-rolling [Step 7], and crystal rotation and integration into the {121}<111> orientation are suppressed while the amount of the {110}<001> oriented grains in a fine state is enhanced.

Herein, in regard to the action of the precipitate, in conventional Cu—(NI, Co)—Si-based alloys, by inducing precipitation of a precipitate having a size of approximately 10 nm, the precipitate itself serves as a resistance to displacement and enhances strength. On the contrary, in the present invention, a significant difference lies in that the action of the precipitate is utilized for the control of the orientation and size of crystals by cold working. Through the discovery of this new action and the new way of texture control achieved by utilizing the discovery, a balance of the characteristics can be achieved between high bending workability and high yield strength, which cannot be excerpted conventionally.

Preferable conditions for the heat treatments and the workings in the steps, are as follows.

The homogenization heat treatment [Step 2] is maintained at 960° C. to 1,040° C., for one hour or longer, and preferably for 5 to 10 hours.

The hot-working [Step 3], such as hot-rolling, is carried out such that the temperature range from the initiation to the end of the hot-working is 500° C. to 1,040° C., and the working ratio is 10% to 90%.

The water cooling [Step 4] is carried out, usually, at a cooling speed of 1° C./sec to 200° C./sec.

The intermediate cold-rolling [Step 5] is carried out at a working ratio of 20% to 70%.

The age-precipitation [Step 6] is also called an aging-precipitation treatment, and the conditions thereof are retention for 5 minutes to 10 hours at 300° C. to 440° C., and a preferred temperature range is 360° C. to 410° C.

The working ratio of the final cold-rolling [Step 7] is 90% or higher, and preferably 95% or higher. The upper limit is not particularly limited, but the working ratio is usually 99.999% or less.

The stress-relief annealing [Step 8] involves retention for 5 seconds to 2 hours at 200° C. to 430° C. If the retention time is too long, strength is lowered. Then, it is preferable to perform annealing for a short time of from 5 seconds to 5 minutes.

Herein, the working ratio (or rolling ratio) is a value defined by the following expression.

$$\text{Working ratio (\%)}=\{(t_1-t_2)/t_1\}\times 100$$

wherein $t_1$ represents the thickness before rolling, and $t_2$ represents the thickness after rolling.

(Physical Properties)

The copper alloy sheet material of the present invention preferably has the following physical properties.

(Vickers Hardness: Hv)

The yield strength characteristics in the present invention are quantitatively determined by Vickers hardness obtained by a Vickers hardness test, which is almost in a proportional relationship with yield strength and which can be quantitatively determined with a smaller specimen as compared to yield strength.

The Vickers hardness of the copper alloy sheet material of the present invention is preferably 280 or more, more preferably 295 or more, and even more preferably 310 or more. The upper limit of this Vickers hardness of the sheet material is not particularly limited, but when punching-pressing workability and the like are also considered, the Vickers hardness of 400 or less is preferred. The Vickers hardness in this specification refers to a value measured according to JIS Z 2244. When the Vickers hardness is within this range, yield strength also has a high value, and an effect is excerpted in which a sufficient contact pressure of an electrical contact can be secured in the case where the copper alloy sheet material of the present invention is used for a connector or the like.

(Yield Strength: YS)

In one preferred embodiment of the copper alloy sheet material of the present invention, an average value of the yield strength (also referred to as yield stress or 0.2% yield stress) in the direction parallel to the rolled direction and in the direction perpendicular to the rolled direction is preferably 1,020 MPa or more, more preferably 1,080 MPa or more, and even more preferably 1,140 MPa or more. The upper limit of this yield strength of the sheet material is not particularly limited, but, for example, the yield strength is 1,400 MPa or less.

(Electrical Conductivity: EC)

The electrical conductivity is preferably 13% IACS or higher, more preferably 15% IACS or higher, even more preferably 17% IACS or higher, and particularly preferably 19% IACS or higher. In regard to the upper limit of the electrical conductivity, if the electrical conductivity exceeds 40% IACS, strength may be lowered. The electrical conductivity is preferably 40% IACS or less, more preferably 34% IACS or les, and even more preferably 31% IACS or less.

In the present invention, yield strength is a value based on JIS Z 2241. Further, the term "% IACS" represents the electrical conductivity in the case where the resistivity of $1.7241\times10^{-8}$ Ωm of the International Annealed Copper Standards is designated as 100% IACS.

(Bending Workability: MBR/t)

Bending workability is expressed by the ratio MBR/t of the minimum bendable radius (MBR) at the inner-side, at which cracks do not occur at the time of bending, to the sheet thickness (t), as a measure. In regard to the copper alloy sheet material of the present invention, in a strength zone in which the yield strength (YS) is 1,020 MPa or more but less than 1,160 MPa, the MBR/t is preferably 2 or less, and more preferably 1 or less. In a strength zone in which the yield strength (YS) is 1,160 MPa or more but less than 1,200 MPa, the MBR/t is preferably 3 or less, and more preferably 2 or less. In a strength zone in which the yield strength (YS) is 1,200 MPa or more but less than 1,280 MPa, the MBR/t is preferably 4 or less, and more preferably 3 or less. The lower limit of this MBR/t is not particularly limited, but the lower limit is usually zero (0).

(Sheet Thickness Range of Product)

In one embodiment of the copper alloy sheet (copper alloy strip) according to the present invention, the thickness is 0.6 mm or less, and in a typical embodiment, the thickness is 0.03 mm to 0.3 mm.

EXAMPLES

The present invention will be described in more detail based on examples given below, but the invention is not meant to be limited by these.

Example 1

Raw materials of each alloy containing the alloying elements described in Table 1, with the balance being Cu and unavoidable impurities, were melted with a high-frequency melting furnace, and this was cast to obtain an ingot. The ingot was subjected to rollings at the rolling ratios described in the following steps, and thereby the size of the ingot was set to obtain the final sheet thickness (0.10 mm) without contradiction. Then, specimens of copper alloy sheet materials of Examples according to this invention and of Comparative Examples apart from those Examples, were respectively produced, by any one of the following production methods A, B, D, and E. Table 1 shows which production method among the methods A, B, D, and E was used. The final thickness of the copper alloy sheet material was set to 0.10 mm (100 μm). This final sheet thickness is also the same in the cases of production methods J, K, L, and M that will be described below, unless otherwise specified. The numbers or the like indicated with underlines in the table mean: whether the content of alloying elements, the orientation density, the density [ρ] of grains having {110}<001> orientation, or the production method, as defined in the present invention, is not satisfied; or whether the physical properties do not satisfy the preferred ranges in the present invention.

(Production Method A)

The ingot was subjected to a homogenization heat treatment of maintaining the ingot for one hour or longer at 960° C. to 1,040° C., and while kept in this high temperature state, the ingot was subjected to hot-rolling to obtain a sheet thickness of 12 mm. Then, the sheet material was immediately water-cooled. Then, after face-milling (chamfering), intermediate cold-rolling at a working ratio of 20% to 70%, an aging treatment of maintaining for 5 minutes to 10 hours at 300° C. to 440° C., final cold-rolling at a working ratio of 90% or more, and stress-relief annealing were carried out, in this order.

(Production Method B)

Without performing the homogenization heat treatment and the hot-rolling of the production method A, after face-milling, the ingot was subjected to intermediate cold-rolling at a working ratio of 20% to 70%, an aging treatment of maintaining for 5 minutes to 10 hours at 300° C. to 440° C., final cold-rolling at a working ratio of 90% or more, and stress-relief annealing, in this order.

(Production Method D)

The ingot was subjected to a homogenization heat treatment of maintaining the ingot for one hour or longer at 960° C. to 1,040° C., and while kept in this high temperature state, the ingot was subjected to hot-rolling to obtain a sheet thickness of 12 mm. Then, the sheet material was immediately water-cooled. Then, after face-milling, intermediate cold-rolling at a working ratio of 20% to 70%, an aging treatment of maintaining for 5 minutes to 10 hours at over 500° C. but 700° C. or less, final cold-rolling at a working ratio of 90% or more, and stress-relief annealing were carried out, in this order.

(Production Method E)

The ingot was subjected to a homogenization heat treatment of maintaining the ingot for one hour or longer at 960° C. to 1,040° C., and while kept in this high temperature state, the ingot was subjected to hot-rolling to obtain a sheet thickness of 12 mm. Then, the sheet material was immediately water-cooled. Then, after face-milling, intermediate cold-rolling at a working ratio of 20% to 70%, an aging treatment of maintaining for 5 minutes to 10 hours at 300° C. to 440° C., final cold-rolling at a working ratio of 80% or higher but less than 90%, and stress-relief annealing were carried out, in this order.

The conditions for the stress-relief annealing for the production methods A, B, D, and E were set to 5 seconds to 2 hours of retention at 200° C. to 430° C. After the heat treatments or rollings, the oxide layer at the surface was removed, if necessary, by face-milling, acid-washing, or surface-polishing, depending on the state of oxidation or roughness of the material surface. Further, if necessary, the sheet materials were subjected to correction by a tension leveler, depending on the shape. Further, in the case where the roughness of the material surface was large due to the transfer of surface unevenness of the rolling rolls or due to oil pits, the rolling conditions, such as the rolling speed, rolling oil, diameter of the rolling rolls, surface roughness of the rolling rolls, and the amount of rolling reduction in one pass at the time of rolling, were regulated.

Further, specimens of copper alloy sheet materials were obtained through test production by any one of the following production methods J, K, L, and M, as other Comparative Examples. For the conditions of the production methods J, K, L, and M, the conditions for the production methods described in the Patent Literatures were followed. However, since the conditions for the solution heat treatment varied depending on the concentrations of adding alloying elements in the alloys, conditions for a solution heat treatment of maintaining at 900° C. for 1 minute were employed, as the conditions for sufficiently forming a solid solution with the concentrations of alloying elements in Example 104 and the like according to those Examples, such as Ni=3.81 mass % and Si=0.91 mass %.

(Production Method J) Production Method Described in Example of Patent Literature 5: WO 2011/068134 A1

Raw materials that would provide a copper alloy composition indicated in Table 1 were cast by a DC method, and an ingot having a thickness of 30 mm, a width of 100 mm, and a length of 150 mm was obtained. Then, this ingot was heated to 950° C. and maintained at this temperature for one hour, and then the ingot was hot-rolled to obtain a thickness of 14 mm. The resultant sheet was subjected to gradually cooling at a cooling speed of 1 K/second, and when the temperature reached 300° C. or lower, the resultant sheet was water-cooled. Then, two surfaces were face-milled by 2 mm each to remove oxide films, and then the resultant sheet was subjected to cold-rolling at a rolling ratio of 90% to 95%. Thereafter, the resultant sheet was subjected to intermediate annealing for 30 minutes at 350° C. to 700° C., and cold-rolling at a cold-rolling ratio of 10% to 30%. Thereafter, a solution treatment for 1 minute at 900° C. was carried out, and the resultant sheet was immediately cooled at a cooling speed of 15° C./second or more. Then, the resultant sheet was subjected to an aging treatment for 2 hours at 400° C. to 600° C. in an inert gas atmosphere, and then was subjected to finish rolling at a rolling ratio of 50% or less. Thus, a final sheet thickness of 100 μm was obtained. After the finish rolling (final cold-rolling), the product was subjected to the stress-relief annealing for 30 seconds at 400° C.

(Production Method K) Production Method Corresponding to Example 3 Described in Patent Literature 6: JP-A-2012-122114

Raw materials which would provide a copper alloy composition indicated in Table 1 were melted with a low-frequency melting furnace in a reducing atmosphere, and then were cast to produce a copper alloy ingot having a dimension of 80 mm in thickness, 200 mm in width, and 800 mm in length. This copper alloy ingot was heated to 900° C. to 980° C., and then was subjected to hot-rolling to obtain a hot-rolled sheet having a thickness of 11 mm. This hot-rolled sheet was water-cooled, and then two faces thereof were face-milled by 0.5 mm each. Then, the resultant sheet was subjected to cold-rolling at a rolling ratio of 87% to produce a cold-rolled sheet having a thickness of 1.3 mm, and then the cold-rolled sheet was subjected to continuous annealing under the conditions of maintaining the cold-rolled sheet for 7 to 15 seconds at 710° C. to 750° C. The resultant cold-rolled sheet was subjected to cold-rolling at a working ratio of 55% (cold-rolling immediately before a solution treatment), and thus a cold-rolled sheet having a predetermined thickness was produced. This cold-rolled sheet was maintained for one minute at 900° C., and then was rapidly cooled to apply a solution treatment. The resultant sheet was subjected to an aging treatment by maintaining the sheet for 3 hours at 430° C. to 470° C. Then, the resultant sheet was subjected to mechanical polishing with particles having a particle size of #600, and an acid-washing treatment of immersing the sheet in a treatment liquid obtained by mixing 5 mass % of sulfuric acid and 10 mass % of hydrogen peroxide, for 20 seconds at a liquid temperature of 50° C. The resultant sheet was subjected to final cold-rolling at a working ratio of 15%, and was then subjected to continuous low-temperature annealing under the conditions of maintaining the sheet for 20 to 60 seconds at 300° C. to 400° C. Thus, a thin copper alloy sheet was produced.

(Production Method L) Production Method Corresponding to Example No. 1 of Example 1 Described in Patent Literature 7: JP-A-2006-9108

Raw materials that would provide a copper alloy composition indicated in Table 1 were melted with an air-melting furnace, and an ingot having a size of 20 mm in thickness× 60 mm in width was cast. This ingot was subjected to homogenization annealing for 3 hours at 1,000° C., and then hot-rolling was initiated at this temperature. At a time point at which the thickness of the ingot reached 15 mm, 10 mm, or 5 mm, the material in the mid course of rolling was re-heated for 30 minutes to 1,000° C., and after hot-rolling, the material was worked to obtain a sheet thickness of 3 mm. Thereafter, the resultant sheet was subjected to face-milling, cold-rolling to obtain a sheet thickness of 0.625 mm (working ratio, 79%), a solution treatment of maintaining the material for one minute at 900° C., water-cooling, cold-rolling to obtain a sheet thickness of 0.5 mm (working ratio, 20%), and an aging treatment of maintaining the material for 3 hours at 400° C. to 600° C., in this order.

(Production Method M) Production Method of Example 10 in Example Described in Patent Literature 8: JP-A-2006-152392

Raw materials that would provide a copper alloy composition indicated in Table 1 were melted in a kryptol furnace in the air under charcoal coating, the molten material was cast into a book mold made of cast iron, and an ingot having a thickness of 50 mm, a width of 75 mm, and a length of 180 mm was obtained. Then, the surface of the ingot was face milled, then the resultant sheet was subjected to hot-rolling at a temperature of 950° C. until the thickness reached 15 mm, and the resultant sheet was rapidly cooled in water from a temperature of 750° C. or higher. Then, oxidation scales were removed, and then cold-rolling was performed at a working ratio of 97%. A solution treatment of heating the sheet for 20 seconds at 825° C. was carried out using a salt bath furnace, and then the resultant sheet was rapidly cooled in water. Then, the resultant sheet was subjected to final cold-rolling at a working ratio of 15%, and thereby a cold-rolled sheet having a thickness of 0.38 mm was obtained. Then, the cold-rolled sheet was subjected to an aging treatment of maintaining the sheet for 4 hours at 420° C.

With respect to the specimens of these Examples according to this invention and Comparative Examples, characteristics were measured and evaluated as follows. The results are presented together in Table 1.

a. Orientation Density

Incomplete pole figures of {111}, {100}, and {110} were measured from a material surface. The sample size of the measured surface was set to be 25 mm×25 mm. An ODF analysis was carried out, based on three pole figures thus measured. Symmetry of the sample was made orthotropic (the object having mirror surfaces in RD and TD), and the order of expansion was set to the $22^{nd}$ order. Then, the orientation densities of the {121}<111> orientation, the {110}<001> orientation, and the {001}<100> orientation, were determined.

b. Density [ρ] of Grains of {110}<001> Orientation

A specimen was scanned with an electron beam at an interval of 0.05 μm according to the FE-SEM/EBSD method, and thus a crystal orientation map was measured and produced, respectively. Herein, a boundary at which the orientation difference was 5° or more was defined as a grain boundary. Measurement was made in three viewing fields each time for one sample, one observation viewing field having a size of 50 μm×50 μm, and thus the crystal orientation map was obtained. An analysis was carried out by extracting grain data which provided a shift angle of ±20° or less at the {110}<001> orientation, which was an ideal orientation, from the crystal orientation map thus obtained, and determining the number of grains having a major axis of 0.2 μm or more among them. Then, the number was divided by the entire area of measurement, and the resultant was designated as the density [ρ(grains/$\mu m^2$)] of grains having the {110}<001> orientation per $\mu m^2$.

c. Vickers Hardness [Hv]

According to JIS Z 2244, Vickers hardness was measured from a material surface or from a section that had been mirror-surface polished. The load was set to 100 gf, and the average of n=10 was determined.

d. Yield Strength [YS]

Test specimens of JIS Z2201 No. 13B that were cut out separately from the respective specimens by taking any one of the direction parallel to the rolled direction (RD) or the direction perpendicular to the rolled direction (TD) as a longitudinal side, were prepared, and measurement was made with three specimens for each sample according to JIS Z2241. Displacements were measured using a contact-type extensometer, a stress-strain curve was obtained, and the 0.2% yield strength was read therefrom. Then, the average value of the yield strength in the direction parallel to the rolled direction: YS (RD) and the yield strength in the direction perpendicular to the rolled direction: YS (TD), was designated as the yield strength.

e. Bending Workability [MBR/t]

A bending test (Good Way bending) was carried out, by taking the bending direction as the direction parallel to the rolled direction, and the bending axis as the direction perpendicular to the rolled direction. From each of the specimens described above, strip-like specimens having a width of 1 mm were obtained by press punching. A 90°-W bending was performed according to JIS Z 2248 by means of the Good Way bending, and the apex of the bent portion was observed with an optical microscope to investigate whether cracks would exist, or not. The test was carried out at six levels with the inner bending radius set at from 0.1 mm to 0.6 mm at an interval of 0.1 mm, and the minimum bending radius (MBR) at which bending could be carried out without forming any cracks was determined. Thus, bending workability was expressed by a value obtained by normalizing the minimum bending radius (MBR) divided by the sheet thickness (t), MBR/t.

f. Electrical Conductivity [EC]

The electrical conductivity was calculated by using the four-terminal method to measure the specific resistance of the respective specimen in a thermostat bath that was maintained at 20° C. (±0.5° C.). The spacing between terminals was set to 100 mm.

TABLE 1

| | | Ni mass % | Co mass % | Si mass % | Production Method | {121} <111> orientation density | {110} <001> orientation density | {001} <100> orientation density |
|---|---|---|---|---|---|---|---|---|
| Example | 101 | 1.83 | — | 0.43 | A | 4 | 5 | 1 |
| | 102 | 2.62 | — | 0.57 | A | 2 | 7 | 1 |
| | 103 | 2.41 | 1.25 | 0.88 | A | 6 | 7 | 1 |
| | 104 | 3.81 | — | 0.91 | A | 2 | 9 | 0 |
| | 105 | 3.21 | 1.35 | 1.05 | A | 5 | 9 | 1 |
| | 106 | 4.62 | — | 1.15 | A | 3 | 11 | 0 |
| | 107 | 6.43 | — | 1.52 | B | 4 | 9 | 1 |
| | 108 | 7.85 | — | 1.86 | B | 5 | 11 | 1 |
| Comparative Example | 151 | 1.72 | — | 0.37 | A | 6 | 5 | 2 |
| | 152 | 8.25 | — | 2.11 | Cracks of the material were occurred in rolling | | | |
| | 153 | 3.81 | — | 0.91 | D | 4 | 3 | 1 |
| | 154 | 3.81 | — | 0.91 | E | 3 | 3 | 1 |
| | 155 | 3.81 | — | 0.91 | J | 4 | 2 | 29 |
| | 156 | 3.81 | — | 0.91 | K | 3 | 5 | 2 |
| | 157 | 3.81 | — | 0.91 | L | 3 | 4 | 1 |
| | 158 | 3.81 | — | 0.91 | M | 3 | 1 | 2 |

| | | Density ρ of grains having {110} <001> orientation Grains/μm$^2$ | Hardness Hv | Yield strength YS MPa | Bending workability MBR/t | Electrical conductivity EC % IACS |
|---|---|---|---|---|---|---|
| Example | 101 | 0.42 | 284 | 1,023 | 1 | 28.4 |
| | 102 | 0.54 | 296 | 1,044 | 1 | 28.1 |
| | 103 | 0.73 | 310 | 1,115 | 2 | 30.5 |
| | 104 | 0.81 | 318 | 1,145 | 2 | 28.6 |
| | 105 | 0.98 | 325 | 1,180 | 2 | 29.6 |
| | 106 | 0.92 | 330 | 1,205 | 3 | 24.6 |
| | 107 | 1.11 | 340 | 1,223 | 3 | 19.1 |
| | 108 | 1.16 | 352 | 1,252 | 4 | 16.4 |
| Comparative Example | 151 | 0.48 | 275 | 978 | 1 | 33.8 |
| | 152 | Cracks of the material were occurredin rolling | | | | |
| | 153 | 0.25 | 271 | 900 | 3 | 44.2 |
| | 154 | 0.35 | 276 | 968 | 2 | 28.1 |
| | 155 | 0.11 | 259 | 872 | 1 | 38.4 |
| | 156 | 0.15 | 245 | 810 | 1 | 35.3 |
| | 157 | 0.14 | 243 | 795 | 1 | 36.5 |
| | 158 | 0.17 | 244 | 805 | 1 | 37.6 |

As shown in Table 1, Examples 101 to 108 that satisfied the definitions in the present invention, each exhibited excellent characteristics. As the concentrations of Ni/Co or Si were higher in the predetermined ranges, the Examples exhibited higher yield strength YS.

On the other hand, in Comparative Examples, since the alloy compositions did not satisfy the conditions defined in the present invention, at least one of the orientation density of the {110}<001> orientation and the density [ρ] of grains having {110}<001> orientation did not satisfy the conditions defined in the present invention. Therefore, Comparative Examples were poor in each characteristics of Vickers hardness Hv and yield strength YS.

In Comparative Example 151, since the concentrations of Ni/Co and Si were too low, the Vickers hardness [Hv] was low, and the yield strength [YS] was poor. Further, in Comparative Example 152 in which the concentrations of Ni/Co and Si were too high, rolling cracks occurred, and the manufacturability was poor. In Comparative Example 153 produced by the production method D, the orientation density of the {110}<001> orientation was low, and the density [ρ] of grains of the {110}<001> orientation was low. In this Comparative Example 153, the electrical conductivity [EC] was high, while the Vickers hardness [Hv] and the yield strength [YS] were poor. Further, despite having low yield strength [YS], this Comparative Example exhibited the bending workability that was poor to that of the Examples according to the present invention. In Comparative Example 154 produced by the production method E, the orientation density of the {110}<001> orientation was low, and the density [ρ] of grains of the {110}<001> orientation was low. In this Comparative Example 154, the electrical conductivity [EC] was high, while the Vickers hardness [Hv] and the yield strength [YS] were poor. Further, despite having low yield strength [YS], this Comparative Example exhibited the bending workability that was poor to that of the Examples according to the present invention.

As other Comparative Examples, in Comparative Example 155 produced by the production method J, Comparative Example 156 produced by the production method K, and Comparative Example 157 produced by the production method L, in each case, the density [ρ] of grains of the {110}<001> orientation was low. In these Comparative Examples 155, 156 and 157, the electrical conductivity [EC] was high, while the Vickers hardness [Hv] and the yield strength [YS] were poor. Among these, in Comparative example 155, the orientation density of the {110}<001> orientation was too small, and the orientation density of the {001}<100> orientation was large.

In Comparative example 158 produced by the production method M, it was known according to the descriptions of Patent Literature 8 that the {001}<100> orientation was strongly integrated. However, according to the additional tests and production made by the inventor of the present invention, the orientation density of the {001}<100> orientation was 2, and the area ratio determined via the EBSD measurement was also as low as 2%. Further, the density [ρ] of grains of the {110}<001> orientation was low, and the electrical conductivity EC} was high, while the Vickers hardness [Hv] and the yield strength [YS] were poor. Further, Comparative Example 158 exhibited results that the orientation density of the {110}<001> orientation was also too small.

Example 2

Copper alloy sheet materials were produced using the copper alloys described in Table 2, and characteristics thereof were evaluated, by the same production methods and the same test and measurement methods as those used in Example 1. The results are presented in Table 2.

TABLE 2

| | | Ni mass % | Co mass % | Si mass % | Other elements mass % | Production Method | {121} <111> orientation density | {110} <001> orientation density | {001} <100> orientation density |
|---|---|---|---|---|---|---|---|---|---|
| Example | 201 | 1.84 | — | 0.45 | Zr = 0.11, Mn = 0.06 | A | 5 | 5 | 1 |
| | 202 | 2.64 | — | 0.59 | Mg = 0.15 | A | 3 | 7 | 0 |
| | 203 | 2.42 | 1.22 | 0.89 | Zn = 1.92 Ag = 0.12 | A | 3 | 8 | 1 |
| | 204 | 3.78 | — | 0.91 | Mg = 0.08 | A | 2 | 10 | 0 |
| | 205 | 3.25 | 1.33 | 1.02 | Cr = 0.15 | A | 4 | 9 | 1 |
| | 206 | 4.65 | — | 1.13 | Mg = 0.12 | A | 2 | 11 | 0 |
| | 207 | 6.41 | — | 1.55 | Sn = 0.22 | B | 4 | 9 | 0 |
| | 208 | 7.88 | — | 1.83 | Fe = 0.23, P = 0.05 | B | 5 | 10 | 0 |
| Comparative Example | 251 | 2.64 | — | 0.59 | Sn = 2.12 | Cracks of the material were occurred in rolling | | | |
| | 252 | 3.81 | — | 0.91 | Mg = 0.15 | D | 4 | 3 | 1 |
| | 253 | 3.81 | — | 0.91 | Mg = 0.15 | E | 3 | 3 | 1 |
| | 254 | 3.81 | — | 0.91 | Mg = 0.15 | J | 4 | 2 | 32 |
| | 255 | 3.81 | — | 0.91 | Mg = 0.15 | K | 3 | 5 | 1 |
| | 256 | 3.81 | — | 0.91 | Mg = 0.15 | L | 3 | 5 | 1 |
| | 257 | 3.81 | — | 0.91 | Mg = 0.15 | M | 3 | 1 | 2 |

| | | Density ρ of grains having {110} <001> orientation Grains/μm$^2$ | Hardness Hv | Yield strength YS MPa | Bending workability MBR/t | Electrical conductivity EC % IACS |
|---|---|---|---|---|---|---|
| Example | 201 | 0.43 | 288 | 1,031 | 1 | 27.8 |
| | 202 | 0.62 | 298 | 1,055 | 1 | 26.8 |
| | 203 | 0.75 | 315 | 1,145 | 2 | 29.1 |
| | 204 | 0.88 | 318 | 1,162 | 2 | 24.7 |
| | 205 | 0.83 | 324 | 1,192 | 2 | 29.5 |
| | 206 | 0.97 | 331 | 1,220 | 3 | 22.3 |
| | 207 | 1.10 | 335 | 1,238 | 3 | 17.7 |
| | 208 | 1.05 | 346 | 1,275 | 4 | 15.9 |
| Comparative Example | 251 | Cracks of the material were occurred in rolling | | | | |
| | 252 | 0.27 | 273 | 915 | 2 | 43.5 |
| | 253 | 0.38 | 277 | 958 | 2 | 27.5 |
| | 254 | 0.09 | 256 | 878 | 1 | 38.5 |
| | 255 | 0.17 | 247 | 823 | 1 | 34.8 |
| | 256 | 0.13 | 244 | 803 | 1 | 35.8 |
| | 257 | 0.16 | 241 | 814 | 1 | 37.5 |

As shown in Table 2, Examples 201 to 208 that satisfied the definitions in the present invention, each exhibited excellent characteristics. A tendency was recognized in which, although not applicable to all of the test examples, the density [ρ] of grains of the {110}<001> orientation is enhanced, and the Vickers hardness [Hv] and the yield strength [YS] are enhanced, due to the effect of adding optionally adding elements.

FIG. 4 shows a photograph of the texture of Example 204. This is a partially enlarged diagram of a grain boundary map obtained via the FE-SEM/EBSD measurement, and only the {110}<001> oriented grains are indicated in white.

On the other hand, in Comparative Examples, since the alloy compositions did not satisfy the conditions defined in the present invention, at least one of the orientation density of the {110}<001> orientation and the density [ρ] of grains having {110}<001> orientation did not satisfy the conditions defined in the present invention. Therefore, Comparative Examples were poor in each characteristics of Vickers hardness Hv and yield strength YS.

In Comparative Example 251, since the optionally adding element was too large, the manufacturability was poor. In Comparative Example 252 produced by the production method D, the orientation density of the {110}<001> orientation was low, and the density [ρ] of grains of the {110}<001> orientation was low. In this Comparative Example 252, the electrical conductivity [EC] was high, while the Vickers hardness [Hv] and the yield strength [YS] were poor. Further, despite having low yield strength [YS], this Comparative Example exhibited the bending workability that was poor to that of the Examples according to the present invention. In Comparative Example 253 produced by the production method E, results similar to those of Comparative Example 252 were obtained.

As other Comparative Examples, in Comparative Example 254 produced by the production method J, Comparative Example 255 produced by the production method K, and Comparative Example 256 produced by the production method L, in each case, the density [ρ] of grains of the {110}<001> orientation was low. In these Comparative Examples 254, 255, and 256, the electrical conductivity [EC] was high, while the Vickers hardness [Hv] and the yield strength [YS] were poor. Among these, in Comparative example 254, the orientation density of the {110}<001> orientation was too small, and the orientation density of the {001}<100> orientation was large.

In Comparative example 257 produced by the production method M, it was known according to the descriptions of Patent Literature 8 that the {001}<100> orientation was strongly integrated. However, according to the additional tests and production made by the inventor of the present invention, the orientation density of the {001}<100> orientation was 2, and the area ratio determined via the EBSD measurement was also as low as 2%. Further, the density [ρ] of grains of the {110}<001> orientation was low, and the electrical conductivity EC} was high, while the Vickers hardness [Hv] and the yield strength [YS] were poor. Further, Comparative Example 257 exhibited results that the orientation density of the {110}<001> orientation was also too small.

FIG. 5 shows a photograph of the texture of Comparative Example 252. This is a partially enlarged diagram of a grain boundary map obtained via the FE-SEM/EBSD measurement, and only the {110}<001> oriented grains are indicated in white.

Further, as a still another Comparative Example, a sample material of a copper alloy sheet material was obtained by producing the material by production method N described below.

(Production Method N) Production Method Corresponding to Example 1 Described in JP-A-2009-074125

A copper-based alloy having a composition of Cu-2.3Ni-0.45Si-0.13Mg (each mass %) produced by melting and casting was subjected to semi-continuous casting using a copper mold, to cast into a rectangular cross-section ingot having a cross-section size of 180 mm×450 mm and a length of 4,000 mm. Then, the ingot was heated to 900° C. and was subjected to hot-rolling at a one-pass average working ratio of 22%, to obtain a thickness of 12 mm. Then, cooling was initiated from 650° C., and the sheet was water-cooled at a cooling speed of about 100° C./min. The two surfaces of the resultant sheet were subjected to face-milling by 0.5 mm each, and then the sheet was subjected to cold-rolling to obtain a thickness of 2.5 mm (working ratio=77.3%) and to an aging treatment for 3 hours at a temperature of 500° C. in an Ar atmosphere. The resultant sheet was further subjected to cold-rolling to obtain a thickness of 0.3 mm (working ratio=88.0%), and was subjected to annealing for 1 minute at 500° C. in an Ar atmosphere, finish cold-rolling to obtain a thickness of 0.15 mm (working ratio=50.0%), and stress-relief annealing for 1 minute at 450° C. in an Ar atmosphere.

With respect to a specimen of this Comparative Example, characteristics were measured and evaluated in the same manner as described above. The results are presented together in Table 3.

TABLE 3

| | | {121} <111> orientation density | {110} <001> orientation density | {001} <100> orientation density |
|---|---|---|---|---|
| Comparative Example | 258 | 8 | 3 | 0 |

| | | Density ρ of grains having {110} <001> orientation Grains/μm$^2$ | Hardness Hv | Yield strength YS MPa | Bending workability MBR/t | Electrical conductivity EC % IACS |
|---|---|---|---|---|---|---|
| Comparative Example | 258 | 0.22 | 260 | 780 | 2 | 47.2 |

Comparative Example 258 produced by the production method N did not satisfy the ranges of the present invention, in relation to the orientation density of the {121}<111> orientation, the orientation density of the {110}<001> orientation, and the density of {110}<001> orientation grains, and exhibited poor Vickers hardness [Hv], and poor yield strength [YS].

From the Examples described above, effectiveness of the present invention was proved.

The invention claimed is:

1. A copper alloy sheet material, having an alloy composition comprising at least one of Ni and Co in an amount of 1.80 to 8.00 mass % in total; Si in an amount of 0.40 to 2.00 mass %; and optionally at least one element selected from the group consisting of Sn, Zn, Ag, Mn, P, Mg, Cr, Zr, Fe, and Ti in an amount of 0.000 to 2.000 mass % in total, with the balance being copper and unavoidable impurities, wherein an orientation density of a {121}<111> orientation is 6 or less, an orientation density of a {110}<001> orientation is 4 or more, and wherein a density of grains having a {110}<001> orientation is 0.40 grains/μm$^2$ or more.

2. The copper alloy sheet material as claimed in claim 1, which contains the at least one element selected from the group consisting of Sn, Zn, Ag, Mn, P, Mg, Cr, Zr, Fe, and Ti in an amount of 0.005 to 2.000 mass % in total.

3. The copper alloy sheet material as claimed in claim 1, wherein a Vickers hardness is 280 or more.

4. A connector formed to contain the copper alloy sheet material as claimed in claim 1.

* * * * *